US011685632B2

(12) United States Patent
Chen et al.

(10) Patent No.: US 11,685,632 B2
(45) Date of Patent: Jun. 27, 2023

(54) ELEVATOR BUFFERING DEVICE AND ELEVATOR SYSTEM

(71) Applicant: Otis Elevator Company, Farmington, CT (US)

(72) Inventors: DaYu Chen, Shanghai (CN); Shaohong Jiang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 201 days.

(21) Appl. No.: 17/097,095

(22) Filed: Nov. 13, 2020

(65) Prior Publication Data

US 2021/0331895 A1 Oct. 28, 2021

(30) Foreign Application Priority Data

Apr. 28, 2020 (CN) ..... 202010351402.1

(51) Int. Cl.
*B66B 5/28* (2006.01)
*B66B 5/00* (2006.01)

(52) U.S. Cl.
CPC ..... *B66B 5/282* (2013.01); *B66B 5/0056* (2013.01); *B66B 5/288* (2013.01)

(58) Field of Classification Search
CPC ..... B66B 5/0056; B66B 5/282; B66B 5/288
See application file for complete search history.

(56) References Cited

U.S. PATENT DOCUMENTS

2007/0240942 A1* 10/2007 Sirigu ..... B66B 5/0056 187/360

FOREIGN PATENT DOCUMENTS

| | | | | |
|---|---|---|---|---|
| CN | 207645565 U | * | 7/2018 | ..... B66B 5/005 |
| CN | 110054047 A | * | 7/2019 | |
| CN | 110526073 A | * | 12/2019 | |
| CN | 112279033 A | * | 1/2021 | ..... B66B 5/0056 |
| CN | 112551297 A | * | 3/2021 | ..... B66B 5/0031 |
| EP | 3470355 A1 | | 4/2019 | |
| ES | 2597810 A2 | * | 1/2017 | |
| JP | H05201647 A | * | 8/1993 | ..... B66B 5/288 |
| JP | 2006131338 A | * | 5/2006 | ..... B66B 5/288 |
| WO | 9723399 A2 | | 7/1997 | |

OTHER PUBLICATIONS

European Examination Report for Application No. 20215020.7; dated Jul. 12, 2021; 7 Pages.

* cited by examiner

*Primary Examiner* — Minh Truong
(74) *Attorney, Agent, or Firm* — Cantor Colburn LLP

(57) ABSTRACT

An elevator buffering device and an elevator system. The elevator buffering device includes a multi-stage buffer including: a body bracket; and a plurality of buffering elements mounted on the body bracket; wherein each of the buffering elements is at different heights when they are driven to operating positions in a vertical direction; a drive mechanism including: a power source for powering the drive mechanism; and a telescopic push rod pivotally connected to the body bracket; and a control element for controlling a telescopic length of the telescopic push rod of the drive mechanism so that one of the plurality of buffering elements on the body bracket is driven to the operating position.

9 Claims, 1 Drawing Sheet

ELEVATOR BUFFERING DEVICE AND ELEVATOR SYSTEM

FOREIGN PRIORITY

This application claims priority to Chinese Patent Application No. 202010351402.1, filed Apr. 28, 2020, and all the benefits accruing therefrom under 35 U.S.C. § 119, the contents of which in its entirety are herein incorporated by reference.

TECHNICAL FIELD

The application relates to the field of elevators, specifically, the application relates to an elevator buffering device for an elevator system.

BACKGROUND ART

As a means to improve passenger walking between floors or to shorten passenger walking distance, passenger transport devices are very common in everyday life. As an example, automatic escalators and lift elevators typically used between building floors, and moving walkways commonly used in large airports are particularly common.

For a lift elevator system, it typically requires setting a dedicated hoistway for mounting each component, including: a car running within the hoistway and a counterweight that achieves force balance with the car. In addition, an elevator buffering device is also typically provided in the hoistway pit. When an elevator runs abnormally and causes a car to drop, a buffer can be used to first buffer the car so as not to result in a serious safety problem. In the relevant national standard, for example GB28621, the requirement for hoistway pit depth is reduced. When running normally, the buffer may be at a lower height. But when a staff is required to enter the hoistway pit for maintenance purposes or other reasons, this height is not sufficient to provide enough risk-protection space. To address such problems, it is contemplated in the prior art to provide an elevator buffering device having two stages of adjustable height. Wherein when the elevator runs normally, the buffering device is adjusted to a gear with a lower height; when maintenance personnel are required to access the hoistway pit due to various conditions (e.g., elevator anomaly), the buffering device is adjusted to a gear with a higher height. Such buffers address the aforementioned problems to some extent. Then, in the actual application, the gear of the buffering device can be adjusted only after the maintenance personnel enters the hoistway pit first; and before leaving the hoistway pit, the gear of the buffering device still needs to be restored. During these two time periods, an undesirable safety problem may still occur.

SUMMARY

The application aims to provide an elevator buffering device and an elevator system for realize automatic adjustment of the arrangement height of the buffering device under various conventional and non-conventional running states of the elevator system.

To achieve at least one object of the present application, according to one aspect of the present application, there is provided an elevator buffering device, comprising: a multi-stage buffer including: a body bracket; and a plurality of buffering elements mounted on the body bracket; wherein each of the buffering elements is at different heights when they are driven to operating positions in a vertical direction; a drive mechanism including: a power source for powering the drive mechanism; and a telescopic push rod pivotally connected to the body bracket; and a control element for controlling a telescopic length of the telescopic push rod of the drive mechanism so that one of the plurality of buffering elements on the body bracket is driven to the operating position.

Optionally, the plurality of buffering elements include a first buffering element mounted at a first end of the body bracket and a second buffering element mounted at a second end of the body bracket, when the first buffering element or the second buffering element is driven to the operating position, they are above the body bracket in the vertical direction.

Optionally, the multi-stage buffer further comprises a mounting base, the first end of the body bracket is pivotally connected to the mounting base.

Optionally, the multi-stage buffer further comprises a limit element disposed on the mounting base; when the second buffering element is driven to the operating position, oscillation of the first end of the body bracket in a direction perpendicular to the pivot trajectory plane is limited by the limit element.

Optionally, the power source is disposed proximate to the second end of the body bracket, the first end of the telescopic push rod is pivotally connected to the power source, and the second end of the telescopic push rod is pivotally connected to the first end of the body bracket; wherein the second end of the telescopic push rod remains higher than the first end of the telescopic push rod in the vertical direction within a telescoping stroke of the telescopic push rod.

Optionally, an included angle of the telescopic push rod with respect to a horizontal plane at a minimum length is associated with: the minimum length, a maximum length, a stroke length of the telescopic push rod, and a rated power of the power source.

Optionally, the multi-stage buffer further comprises a vertical connection part disposed at the first end of the body bracket, the vertical connection part having a height that is higher than the body bracket, the second end of the telescopic push rod being indirectly pivotally connected to the first end of the body bracket through an upper portion pivotally connected to the vertical connection part.

Optionally, a support tab is further provided between the first end and the second end of the body bracket; when the first buffering element is driven to the operating position, a supporting force is collectively provided by the sides of the body bracket and the support tab.

Optionally, one of each of the buffering elements is driven to the operating position in the vertical direction of at least not lower than 600 mm, and the other of each of the buffering elements is driven to the operating position in the vertical direction of at least not higher than 200 mm.

Optionally, the body bracket is configured as a hollow extrusion element or a sheet metal element with reinforcing ribs disposed therein.

Optionally, the telescopic push rod has a self-locking element; wherein the self-locking element locks the telescopic push rod when any one of the plurality of buffering elements is driven to the operating position.

To achieve at least one object of the present application, according to another aspect of the present application, there is provided an elevator buffering device, comprising: a multi-stage buffer comprising: a body bracket; and a plurality of buffering elements mounted on the body bracket; wherein each of the buffering elements is at different heights when they are driven to an operating position in a vertical direction; a drive mechanism controlled to drive the multi-stage buffer; and a control element configured to communicate with an elevator controller and to control the drive mechanism to drive the multi-stage buffer upon receipt of a signal that the elevator runs abnormally issued by the elevator controller such that one of the plurality buffering elements on the body bracket driven to the operating position has a first height; and to control the drive mechanism to drive the multi-stage buffer upon receipt of a signal that the elevator runs normally issued by the elevator controller such that the other one of the plurality of buffering elements on the body bracket driven to the operating position has a second height; wherein the first height is greater than the second height.

To achieve at least one object of the present application, according to yet another aspect of the present application, there is provided an elevator system comprising: an elevator controller, a car, and the elevator buffering device as described above; wherein the elevator controller is configured to communicate with a control element of the elevator buffering device; wherein the control element controls the drive mechanism to drive the multi-stage buffer upon receipt of a signal that the car runs abnormally issued by the elevator controller such that one of the plurality buffering elements on the body bracket driven to the operating position has a first height; and control the drive mechanism to drive the multi-stage buffer upon receipt of a signal that the elevator runs normally issued by the elevator controller such that the other one of the plurality of buffering elements on the body bracket driven to the operating position has a second height; wherein the first height is greater than the second height.

Optionally, each of the buffering elements is positioned in the vertical direction within 100 mm of a center of the car bottom when each of the buffering elements in the elevator buffering device is driven to the operating position in the vertical direction.

The elevator buffering device and the elevator system according to the present application, by configuring appropriate driving mechanism for the multi-stage buffer, enable the buffer to automatically adjust the height of the buffering device on demand, so as to meet the requirement of the arrangement height of the buffering device under various conventional and non-conventional running states of the elevator system; also, such driving mechanism reasonably utilizes the telescopic push rod to reduce the required power for driving the multi-stage buffer, so that the power source of the driving mechanism can be miniaturized, and further provides the compact structure space within the elevator hoistway.

DETAILED DESCRIPTION

Figure 1:
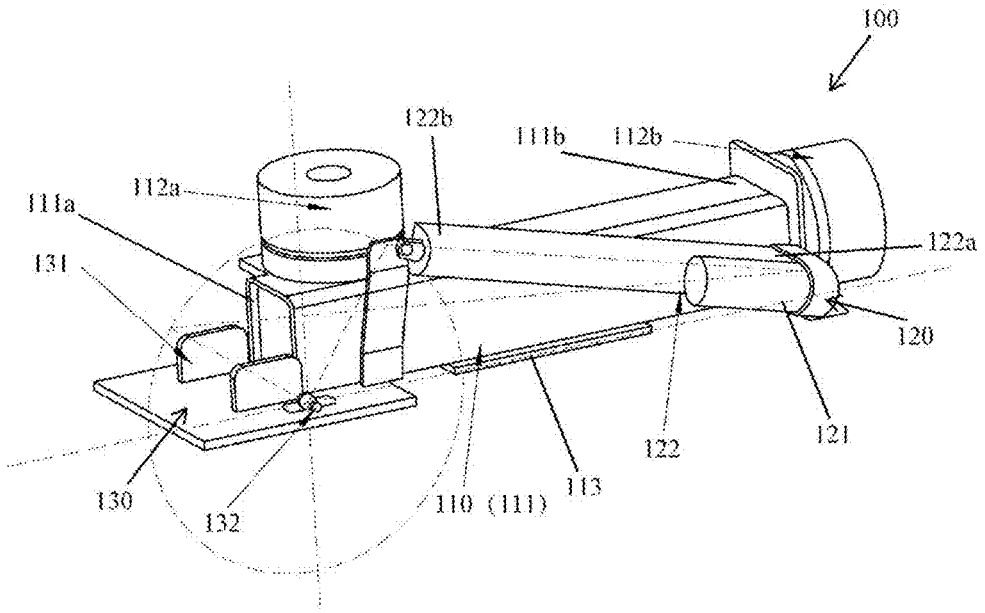
FIG. 1 is a perspective schematic view of one embodiment of an elevator buffering device.

The present application will be described in detail below with reference to exemplary embodiments in the drawings. It should be understood, however, that this application may be implemented in many different forms and should not be construed as limited to the embodiments set forth herein. These embodiments are provided here so that the disclosure of the application will be more complete and detailed, and the concept of the application will fully convey to those skilled in the art.

In addition, for any single technical feature described or implied in the embodiments mentioned herein, or any single technical feature shown or implied in each figure, the application still allows to continue to make any combination or subtraction between these technical features (or equivalents thereof) without any technical barrier, thereby obtaining more other embodiments of the present application that may not be mentioned directly herein.

Figure 2:
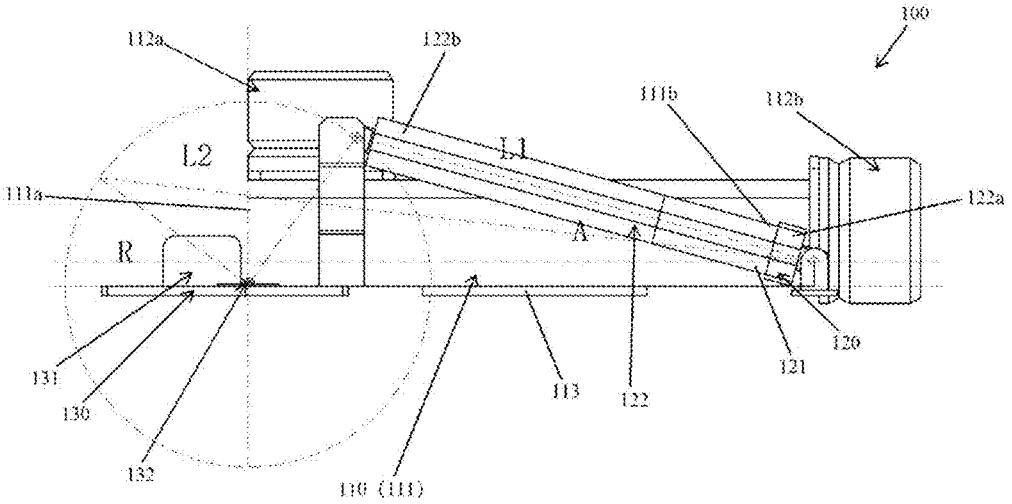
FIG. 2 is a schematic view of the setting of the angle between the telescopic push rod and the horizontal plane of the elevator buffering device.

One embodiment of an elevator buffering device is described herein in conjunction with FIGS. 1-2 of the application. The elevator buffering device 100 includes a multi-stage buffer 110, a drive mechanism 120, and a control element, which is contemplated to control the drive mechanism 120 by the control element to enable inter-stage adjustment of the multi-stage buffer so that it can provide different buffer heights to ground in the elevator hoistway pit, so as to both satisfy the national standard and to provide enough travelling space in specific circumstances.

Specifically, the multi-stage buffer 110 includes a body bracket 111 and two buffering elements 112*a*, 112*b* mounted on the body bracket 111, and is at a different height when each of the buffering elements 112*a*, 112*b* is driven into an operating position in a vertical direction. As can be known from the figures, the first buffering element 112*a* in the figure is currently in an operating position in the vertical direction with a relatively small buffer height to ground, and if the first buffering element 112*b* is driven to an operating position in the vertical direction, then it has a higher buffer height to ground relative to the first buffering element 112*a*. Although two buffering elements are shown by way of example, it should be appreciated that in the foregoing teachings, more than two buffering elements may be arranged by adjusting the structural form of the body bracket 111 (e.g., to approximate the form of a fanning frame), and when each buffering element is driven to the operating position in the vertical direction, they each has a different buffer height to ground from each other, thereby achieving different requirements for the travelling space of the hoistway pit.

In addition, the drive mechanism 120 includes a power source 121 and a telescopic push rod 122. Wherein, the telescopic push rod 122 is pivotally connected to the body bracket 111 so that the two have a linkage relationship, thereby the rotation action of the body bracket 111 can be achieved by adjusting the telescopic length of the telescopic push rod 122, and finally enable rotating at least one of each buffering elements to the operating position. The power source 121 is then used to power the telescopic push rod 122, causing it to telescope. Considering that a relatively stable connection relation needs to be maintained between the buffering element in the operating position, the body bracket and the telescopic push rod, a self-locking element may be configured for the telescopic push rod, self-locking can be achieved when the telescopic push rod is moved to a set position, and thus a more stable effect is provided.

Furthermore, in order to achieve automatic adjustment of the buffer height to ground of the elevator buffering device, a control element is also included. The control element is used to control the telescopic length of the telescopic push rod 122 of the drive mechanism 120 so that one of the plurality of buffering elements 112*a*, 112*b* on the body bracket 111 is driven to the operating position.

Under such arrangement, the elevator buffering device according to the present application, by configuring appropriate driving mechanism 120 for the multi-stage buffer 110, enable the buffer to automatically adjust the height of the buffering device on demand, so as to meet the requirement of the arrangement height of the buffering device under various conventional and non-conventional running states of the elevator system; also, such driving mechanism 120 reasonably utilizes the telescopic push rod 122 to reduce the required power for driving the adjustment of the multi-stage buffer 110, so that the power source 121 of the driving mechanism 120 can be miniaturized, and further provides the compact structure space within the elevator hoistway.

Additionally, with respect to the automatic adjustment of elevator buffering devices described in the application, it should be appreciated that instructions may be issued to the control element before entering and after exiting in a variety of ways to ensure the multi-stage buffer has been adjusted to a suitable height before the maintenance personnel or other personnel entering into the hoistway pit, and to ensure that the multi-stage buffer has also been adjusted to a suitable height after the maintenance personnel or other personnel exiting the hoistway pit.

For example, where there is sufficient hardware support, the control element may be configured to communicate with a specific mobile terminal to directly accept control instructions issued by the maintenance personnel.

As another example, the control element may also be configured to communicate directly with the elevator controller and control the drive mechanism 120 to drive the multi-stage buffer 110 upon receipt of a signal that the elevator runs abnormally issued by the elevator controller such that one of the two buffering elements 112*a*, 112*b* on the body bracket 111 driven to the operating position has a first height; and control the drive mechanism 120 to drive the multi-stage buffer 110 upon receipt of a signal that the elevator runs normally issued by the elevator controller such that the other one of the two buffering elements 112*a*, 112*b* on the body bracket 111 driven to the operating position has a second height; wherein the first height is greater than the second height.

This is because, according to the national standard, when the elevator is running normally, the empty space of the hoistway pit should usually be kept as small as possible, for example, the second height is made at least not higher than 200 mm; and when the elevator is running abnormally, for ease of the maintenance personnel entering the hoistway pit for maintenance, the buffer space of the hoistway pit left for the buffering element should be as large as possible, for example, the first height is made at least not lower than 600 mm to avoid safety problems.

Further description will be made below with respect to specific constructions of various mechanisms in the aforementioned elevator buffering devices and their interconnecting relationships or positional relationships.

Firstly, the buffering elements 112*a*, 112*b* include a first buffering element 112*a* mounted at a first end 111*a* of the body bracket 111 and a second buffering element 112*b* mounted at a second end 111*b* of the body bracket 111; wherein, when the first buffering element 112*a* or the second buffering element 112*b* is driven to the operating position, it is above the body bracket 111 in the vertical direction. In conjunction with the drawings, it can be seen that the ends referred to in this application refer to a portion near both ends of the body bracket 111, which is not limited to only two end faces, but also includes both the end faces and a partial section extending toward the center of the body bracket 111. As can also be seen, the described buffering element mounted on the end may not only be mounted on either the end face (as shown by the second buffering element 112*b*), but may also be mounted on the side section near the end face of the body bracket 111 (as shown by the first buffering element 112*a*), the selection of the specific mounting position of which is intended to be positioned just above the body bracket 111 when moving to a vertical direction so as to provide a desired buffer for the car.

In addition, to provide a stable and reliable mounting foundation for the multi-stage buffer 110, a mounting base 130 may also be provided. At this time, the first end 111*a* of the body bracket 111 is pivotally connected to the mounting base 130, i.e., by rotational movement of the body bracket 111 relative to the mounting base 130, the different buffering elements are switched to their operating positions. On this basis, the multi-stage buffer 110 further includes a limit element 131 disposed on the mounting base 130. When the second buffering element 112*b* is driven to the operating position, the oscillation of the first end 111*a* of the body bracket 111 in a direction perpendicular to the pivot trajectory plane is limited by the limit element 131, thereby ensuring the body bracket to remain stable after it is moved into position.

For another example, power source 121 may also be disposed proximate to the second end 111*b* of body bracket 111, the first end 122*a* of the telescopic push rod 122 is pivotally connected to power source 121, and the second end 122*b* of the telescopic push rod 122 is pivotally connected to first end 111*a* of the body bracket 111; wherein, within the telescopic stroke of the telescopic push rod 122, the second end 122*b* of the telescopic push rod 122 remains higher than the first end 122*a* of the telescopic push rod 122 in the vertical direction. Such arrangement enables the drive point of the power source 121 to be as far as possible from the pivot shaft 132 of the body bracket 111, and by adjusting the included angle and the length of the telescopic push rod to achieve a change in a drive torque, providing the torque that is sufficient to drive the body bracket by cooperating a longer arm of force with a motor having a relatively smaller rated power is enabled, the motor having a smaller power has a smaller volume correspondingly and is also more suitable for a compact spatial arrangement within the hoistway pit.

Specifically, referring to FIG. 2, the included angle of telescopic push rod 122 with respect to the horizontal plane at a minimum length is associated with: the minimum length, the maximum length, the stroke length of telescopic push rod 122, and the rated power of the power source 121. For example, when the telescopic push rod 122 is at the minimum length, its included angle with respect to the horizontal plane is minimized, at which point the first buffering element 112*a* is in the operating position; while when the telescopic push rod 122 is at the maximum length, its included angle with respect to the horizontal plane is maximized, at which point the second buffering element 112*b* is in the operating position; in addition, based on the weight of the device, the rated power of the power source 121 is configured such that when the weight is greater, the required rated power also increases accordingly.

Returning to FIG. 1, to further increase the possibilities of selecting an included angle, the multi-stage buffer 110 also includes a vertical connection part disposed at the first end 111*a* of the body bracket 111, the vertical connection part having a height that is higher than the body bracket 111. At this time, when the design requires a greater included angle, this can be achieved by pivotally connecting the second end

122*b* of the telescopic push rod 122 to the upper portion of the vertical connection part and pivotally connecting the second end 122*b* to the first end 111*a* of the body bracket 111 indirectly.

Further, as can be known from the figures, when the first buffering element 112*a* is driven to the operating position, the body bracket 111 is presented in a horizontal form that when the car is against the first buffering element 112*a*, supporting force will be provided by the sides of the entire body bracket 111. In such a case, it may be considered to reducing the pressure by increasing the area of thrust surface. For example, a support tab 113 is also provided between the first end 111*a* and the second end 111*b* of the body bracket 111; at this time, when the first buffering element 112*a* is driven to the operating position, the supporting force will be collectively provided by the sides of the body bracket 111 and the support tab 113.

Further, optionally, the body bracket 111 may also be configured as a hollow extrusion element with reinforcing ribs disposed therein, thereby reducing the weight of components while ensuring the strength.

In addition, although not shown in the figures, an embodiment of an elevator system is also provided. The elevator system includes an elevator controller, a car, and an elevator buffering device 100 in any of the previous embodiments or a combination thereof, and thus also has technical effects brought by the elevator buffering device, which is not repeated herein. In addition, the elevator controller is configured to communicate with a control element of the elevator buffering device 100; wherein, the control element controls the drive mechanism 120 to drive the multi-stage buffer 110 upon receipt of a signal that the car runs abnormally issued by the elevator controller such that one of the two buffering elements 112*a*, 112*b* on the body bracket 111 driven to the operating position has a first height; and control the drive mechanism 120 to drive the multi-stage buffer 110 upon receipt of a signal that the elevator runs normally issued by the elevator controller such that the other one of a plurality of buffering elements 112*a*, 112*b* on the body bracket 111 driven to the operating position has a second height; wherein the first height is greater than the second height. This is because, according to the national standard, when the elevator is running normally, the empty space of the hoistway pit should usually be kept as small as possible, for example, the second height is made at least not higher than 200 mm; and when the elevator is running abnormally, for ease of the maintenance personnel entering the hoistway pit for maintenance, the buffer space of the hoistway pit left for the buffering element should be as large as possible, for example, the first height is made at least not lower than 600 mm to avoid safety problems.

In such arrangement, the automatic adjustment of the elevator buffering device is directly associated to the elevator controller of the elevator system so that when the elevator system is running normally, the multi-stage buffer in the elevator buffering device is always in a state to arrange the buffering element at a lower height in the operating position so that the design specification meets the requirements of national standard completely; while when the elevator system is running abnormally, the elevator controller directly issues a control signal to the control element of the elevator buffering device to cause it to control the driving mechanism to adjust the multi-stage buffer, so that the buffering element at a higher height is arranged in the operating position, so that enough buffer height is preserved for the hoistway pit and the safety of maintenance personnel is guaranteed during operation in the hoistway pit.

In addition, optionally, the arrangement position of the elevator buffering device 100 relative to the car and the relative position relationship between the elements of the elevator buffering device 100 can also be adjusted such that each buffering element 112*a*, 112*b* is positioned in the vertical direction within 100 mm of the center of the car bottom when the respective buffering elements 112*a*, 112*b* in the elevator buffering device 100 are driven to the operating position in the vertical direction.

The above examples mainly illustrate the elevator buffering device and the elevator system of the present application. While only some of the embodiments of the present application have been described, it will be appreciated by those of ordinary skill in the art that the present application may be implemented in many other forms without departing from its spirit and scope. Accordingly, the illustrated examples and embodiments are to be considered as illustrative and not restrictive, and various modifications and substitutions may be encompassed by the application without departing from the spirit and scope of the present application as defined by the appended claims.

What is claimed is:

1. The An elevator buffering device, comprising:

a multi-stage buffer including: a body bracket; and a plurality of buffering elements mounted on the body bracket; wherein each of the buffering elements is at different heights when they are driven to operating positions in a vertical direction;

a drive mechanism including: a power source for powering the drive mechanism; and a telescopic push rod pivotally connected to the body bracket; and a control element for controlling a telescopic length of the telescopic push rod of the drive mechanism so that one of the plurality of buffering elements on the body bracket is driven to the operating position;

wherein the plurality of buffering elements include a first buffering element mounted at a first end of the body bracket and a second buffering element mounted at a second end of the body bracket, when the first buffering element or the second buffering element is driven to the operating position, they are above the body bracket in the vertical direction;

wherein the multi-stage buffer further comprises a mounting base, the first end of the body bracket is pivotally connected to the mounting base;

wherein the power source is disposed proximate to the second end of the body bracket, a first end of the telescopic push rod is pivotally connected to the power source, and a second end of the telescopic push rod is pivotally connected to the first end of the body bracket; wherein the second end of the telescopic push rod remains higher than the first end of the telescopic push rod in the vertical direction within a telescoping stroke of the telescopic push rod.

2. The elevator buffering device of claim 1, wherein the multi-stage buffer further comprises a limit element disposed on the mounting base; when the second buffering element is driven to the operating position, oscillation of the first end of the body bracket in a direction perpendicular to the pivot trajectory plane is limited by the limit element.

3. The elevator buffering device of claim 1, wherein the multi-stage buffer further comprises a vertical connection part disposed at the first end of the body bracket, the vertical connection part having a height that is higher than the body bracket, the second end of the telescopic push rod being pivotally connected to the vertical connection part.

4. The elevator buffering device of claim 1, wherein a support tab is further provided between the first end and the second end of the body bracket; when the first buffering element is driven to the operating position, a supporting force is collectively provided by the sides of the body bracket and the support tab.

5. The elevator buffering device of claim 1, wherein one of each of the buffering elements is driven to the operating position in the vertical direction of at least not lower than 600 mm, and the other of each of the buffering elements is driven to the operating position in the vertical direction of at least not higher than 200 mm.

6. The elevator buffering device of claim 1, wherein the body bracket is configured as a hollow extrusion element or a sheet metal element with reinforcing ribs disposed therein.

7. The elevator buffering device of claim 1, wherein the telescopic push rod has a self-locking element; wherein the self-locking element locks the telescopic push rod when any one of the plurality of buffering elements is driven to the operating position.

8. An elevator system comprising:

an elevator controller, a car, and the elevator buffering device of claim 1; wherein the elevator controller is configured to communicate with a control element of the elevator buffering device;

wherein the control element controls the drive mechanism to drive the multi-stage buffer upon receipt of a signal that the car runs abnormally issued by the elevator controller such that one of the plurality buffering elements on the body bracket driven to the operating position has a first height; and control the drive mechanism to drive the multi-stage buffer upon receipt of a signal that the elevator runs normally issued by the elevator controller such that the other one of the plurality of buffering elements on the body bracket driven to the operating position has a second height;

wherein the first height is greater than the second height.

9. The elevator system of claim 8, wherein each of the buffering elements is positioned in the vertical direction within 100 mm of a center of the car bottom when each of the buffering elements in the elevator buffering device is driven to the operating position in the vertical direction.

* * * * *